United States Patent [19]

Ishii et al.

[11] Patent Number: 4,986,176

[45] Date of Patent: Jan. 22, 1991

[54] DEVICE FOR CONNECTING AND DISCONNECTING DAMPENING SYSTEM AND INKING SYSTEM IN OFFSET PRINTING MACHINE

[75] Inventors: Koji Ishii; Naoki Ikeda, both of Fuchu, Japan

[73] Assignee: Ryobi Ltd., Hiroshima, Japan

[21] Appl. No.: 350,889

[22] Filed: May 12, 1989

[30] Foreign Application Priority Data

May 13, 1988 [JP] Japan ..... 63-117969

[51] Int. Cl.[5] ..... B41F 23/04; B41F 23/16

[52] U.S. Cl. ..... 101/148; 101/352

[58] Field of Search ..... 101/148, 350, 351, 352, 101/349, 147, 207–210, 137, 142–144

[56] References Cited

U.S. PATENT DOCUMENTS 3,842,735 10/1974 Southam et al. ..... 101/148

4,351,236 9/1982 Beisel et al. ..... 101/148

*Primary Examiner*—J. Reed Fisher

*Attorney, Agent, or Firm*—Sughrue, Mion, Zinn, Macpeak and Seas

[57] ABSTRACT

A device for connecting and disconnecting a dampening system B and an inking system A in an offset printing machine. The offset printing machine includes a plate cylinder 7, and the inking system includes an ink applicator roller 10 movable toward and away from the plate cylinder. The ink applicator roller is in rotational contact with an ink delivery roller 19. The ink delivery roller is in rotational contact with an intermediate roller 15 which is movable toward and away from a roller 16 of the dampening system. The ink delivery roller and the intermediate roller are both rotatably supported by a pair of brackets 27,27 pivotally supported to an inking frame 25,25. The ink delivery roller and the intermediate roller are also slidable with respect to the brackets. In accordance with the movement of the ink applicator roller, the ink delivery roller is slidably moved, yet connection and disconnection between the inking and dampening systems is attainable.

11 Claims, 5 Drawing Sheets

DEVICE FOR CONNECTING AND DISCONNECTING DAMPENING SYSTEM AND INKING SYSTEM IN OFFSET PRINTING MACHINE

BACKGROUND OF THE INVENTION

The present invention relates to a device for connecting and disconnecting a dampening system and an ink supply system in an offset printing machine.

Generally, as shown in FIGS. 1(*a*) and 1(*b*) of the accompanying drawings, an offset printing machine includes an ink supply system or inking system A operatively coupled to a drive source (not shown) of the printing machine and a dampening medium supply system or dampening system B operatively coupled to the drive source or drivable by an independent motor (not shown). Ink and a dampening medium are supplied by the inking system A and the dampening system B, respectively, to and coated On a master plate (not shown) disposed over a plate cylinder 7. The mixture of the ink and the dampening medium is then transferred onto a blanket cylinder 6, so that an image corresponding to an image of the original master plate is transferred onto the blanket cylinder 6. Then the inked image on the blanket cylinder 6 is transferred onto a printing sheet 1 of paper fed between the blanket cylinder 6 and an impression cylinder 8 by a sheet feed mechanism 2. The printed sheet 1 is then discharged onto a sheet table 4 by a sheet discharge mechanism 3.

As shown in FIGS. 1(*a*) and 1(*b*), the inking system A includes an ink fountain roller 11 and ink applicator rollers 5, 10, and further includes, between the fountain roller 11 and the ink applicator rollers 5, 10, an ink ductor roller 12, an ink fast roller 13, a first ink delivery roller 14, an ink delivery transfer roller 17, a second ink delivery roller 18, a third ink delivery.roller 19, and an ink transfer roller 20.

Further, as shown in FIGS. 1(*a*) and 1(*b*), the dampening system B includes a dipping roller 22 and an applicator roller 9, and further includes, between these rollers 22 and 9, a dampening medium tank 21, a metering roller 24, a dampening medium distributor or ductor roller 23 (23') and a transfer roller 16. The contact pressure between the metering roller 24 and the fountain roller 22 is variable to control the amount of water supplied to the applicator rollers in the device shown in FIG. 1(*a*). On the other hand, in the conventional device shown in FIG. 1(*b*), the dampening medium ductor roller 23' is movable between the fountain roller 22 and the transfer roller 16 to control the amount of water supplied to the applicator rollers.

In order for the printing machine to produce good prints, it is necessary that ink be continuously and smoothly supplied to the dampening system B by the inking system A, or the dampening medium be continuously and smoothly supplied to the inking system A by the dampening system B, or the dampening medium and ink be continuously and smoothly supplied between the inking and dampening systems A and B, dependent on the types of the ink and printing sheets or the area of an image to be printed.

In this connection, in the conventional devices shown in FIGS. 1(*a*) and 1(*b*), an intermediate roller 15 is provided which is movable between the inking and dampening systems A and B, i.e., between the third ink delivery rollers 19 and the dampening medium transfer roller 16.

FIG. 2 shows still another conventional device which particularly concerns a device for connecting and disconnecting a dampening system B' and an ink supply system A' in an offset printing machine which is designed to meet the above requirements. The device shown in FIG. 2 has an ink distributor roller or an intermediate roller 15*a* disposed between a dampening medium applicator roller 9 and an ink applicator roller 10. As described above, the roller 9 is held against an original plate on a plate cylinder 7 for applying a dampening medium to the original plate, and the ink applicator rollers 5, 10 are adapted for applying ink to the original plate. The distributor or the intermediate roller 15*a* is movable between the applicator rollers 9 and 10 for connecting and disconnecting the dampening system B' and inking system A'. The intermediate roller 15*a* is rotatably supported on a bracket b on which the ink applicator roller 10 is also supported. The bracket b is pivotally supported to a shaft 20*a* of an ink transfer roller 20, so that the ink applicator roller 10 can be moved toward and away from the master plate disposed over the plate cylinder 7. This conventional structure is described in Japanese Patent Application Kokai No. 55-57464.

In the conventional arrangement shown in FIG. 2, since the distributor roller 15*a* as well as the ink applicator roller 10 are supported on the identical bracket b, when the ink applicator roller 10 is held against the plate cylinder 7, the intermediate roller 15*a* is also held against the water applicator roller 9. Therefore, according to the conventional arrangement, the dampening system B' and ink supply system A' cannot be separated from each other, when the ink applicator roller 10 is in contact with the plate cylinder 7. Conversely, when the dampening system B' and ink supply system A' are separated from each other, the ink applicator roller 10 cannot be brought into contact with the plate cylinder 7. Another problem is that the entire device is complex in structure. U.S. Pat. No. 4,351,236 discloses a combined dampening and inking unit similar to the device described above.

SUMMARY OF THE INVENTION

In view of the aforesaid problem of the conventional arrangement, it is an object of the present invention to provide an improved device for connecting and disconnecting an inking system and a dampening system in an offset printing machine.

Another object of this invention is to provide such improved device in which connection and disconnection between the inking and dampening systems are easily achievable regardless of the positions of ink applicator rollers and a dampening medium applicator roller relative to a plate cylinder.

Still another object of this invention is to provide such device capable of separating the inking and dampening systems from each other, even if the ink applicator rollers are in contact with the plate cylinder.

These and other objects of the invention will be attained by providing a device for connecting and disconnecting dampening system and inking system in an offset printing machine, the offset printing machine including a plate cylinder, and the dampening system including a first roller train having a plurality of rollers and a dampening medium applicator roller contactable with the plate cylinder, and the inking system including a second roller train having a plurality of rollers and at least one ink applicator rollers contactable with the plate cylinder, the device comprising: a frame body having side walls; a pair of brackets each pivotally supported to each one of the side walls and being pivotally movable about a pivot axis; a first intermediate roller rotatably supported to the pair of brackets, the first intermediate roller being also slidable with respect to the brackets in a first direction, the first intermediate roller having a biasedly rested position when the ink applicator roller is in contact with the plate cylinder, and providing a biasedly rested rotation axis at the rested position, the first intermediate roller being also in rotational contact with a first stationary neighbouring roller positioned immediately upstream side thereof which neighbouring roller belongs to the inking system and provides a stationary rotation axis, the first direction being oriented in a direction perpendicular to a line connecting between the rested rotation axis and the stationary rotation axis; a second intermediate roller rotatably supported to the pair of brackets, the second intermediate roller being also slidable with respect to the brackets in a second direction, the second intermediate roller having a biasedly rested position when the ink applicator roller is in contact with the plate cylinder, and providing a biasedly rested rotation axis at the biasedly rested position, the second intermediate roller being also in rotational contact with a second stationary neighbouring roller positioned immediately upstream side thereof which second neighbouring roller belongs to the dampening system and provides fixed stationary rotation axis, the second direction being oriented in a direction perpendicular to a line connecting between the biasedly rested rotation axis and the fixed stationary rotation axis; and, means for pivoting the brackets about the pivot axis, the means for pivoting being connected to the brackets for moving the second intermediate roller toward and away from the neighbouring second stationary roller, whereby the dampening system and the inking system are connected to each other or disconnected from each other.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1A:
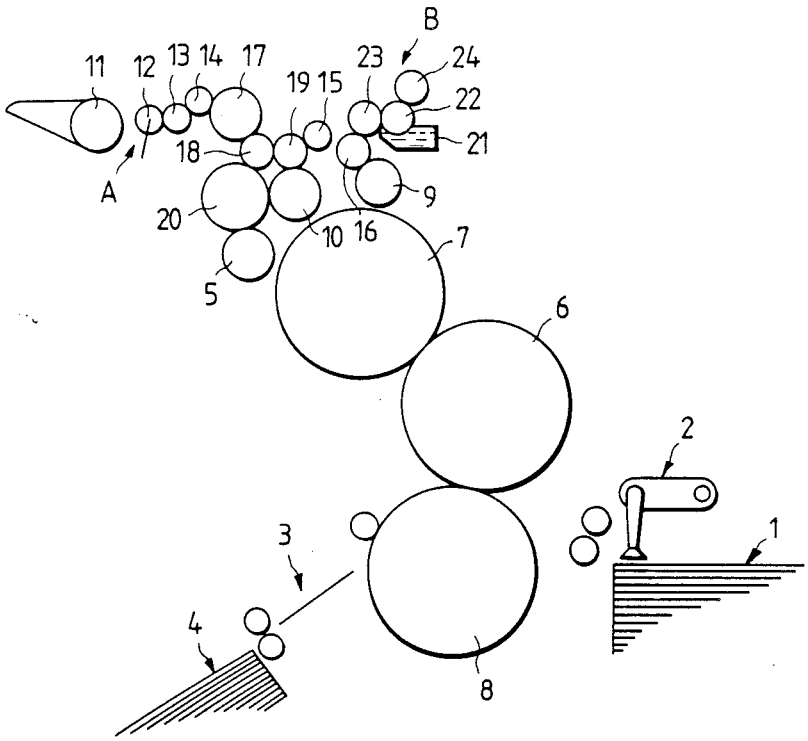
FIG. 1(a) PRIOR ART
FIG. 1(*a*) and 1(*b*) are schematic views showing conventional offset printing machines.

A device for connecting and disconnecting inking and dampening systems according to this invention will be described with reference to FIGS. 3 through 5, wherein like parts and components are designated by the same reference numerals and characters as those shown in FIGS. 1 and 2.

Figure 1B:
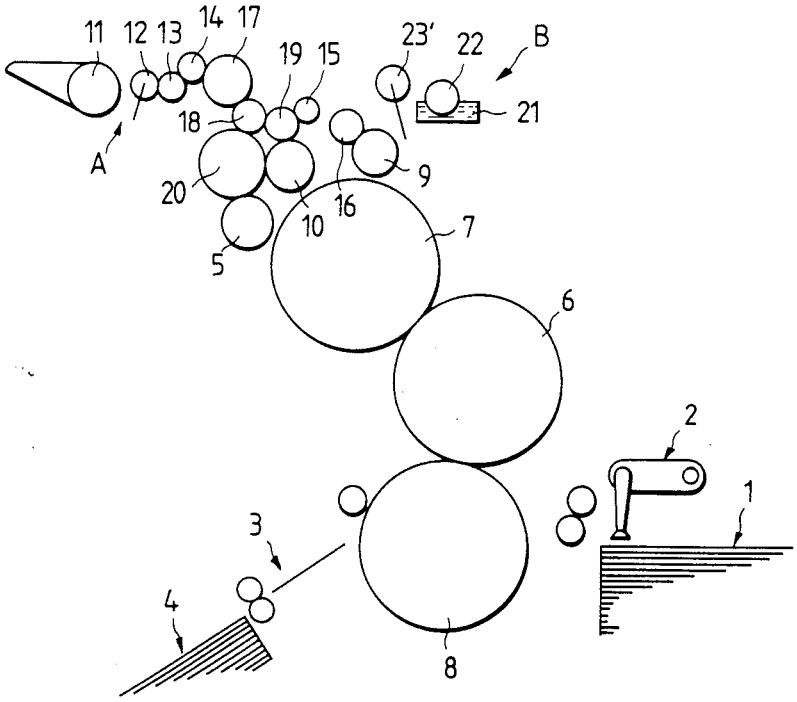
FIG. 1(b) PRIOR ART
Figure 2:
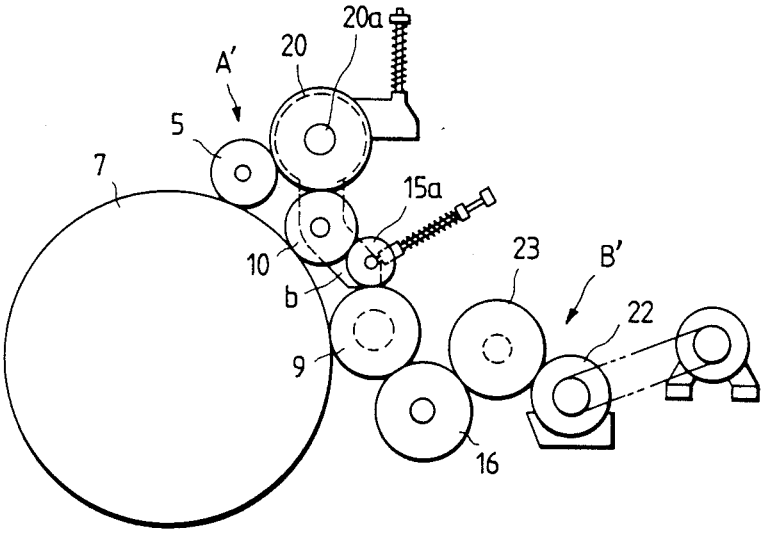
FIG. 2 PRIOR ART
FIG. 2 is a vertical cross-sectional view showing a conventional device for connecting and disconnecting dampening and inking systems in an offset printing machine.
Figure 3:
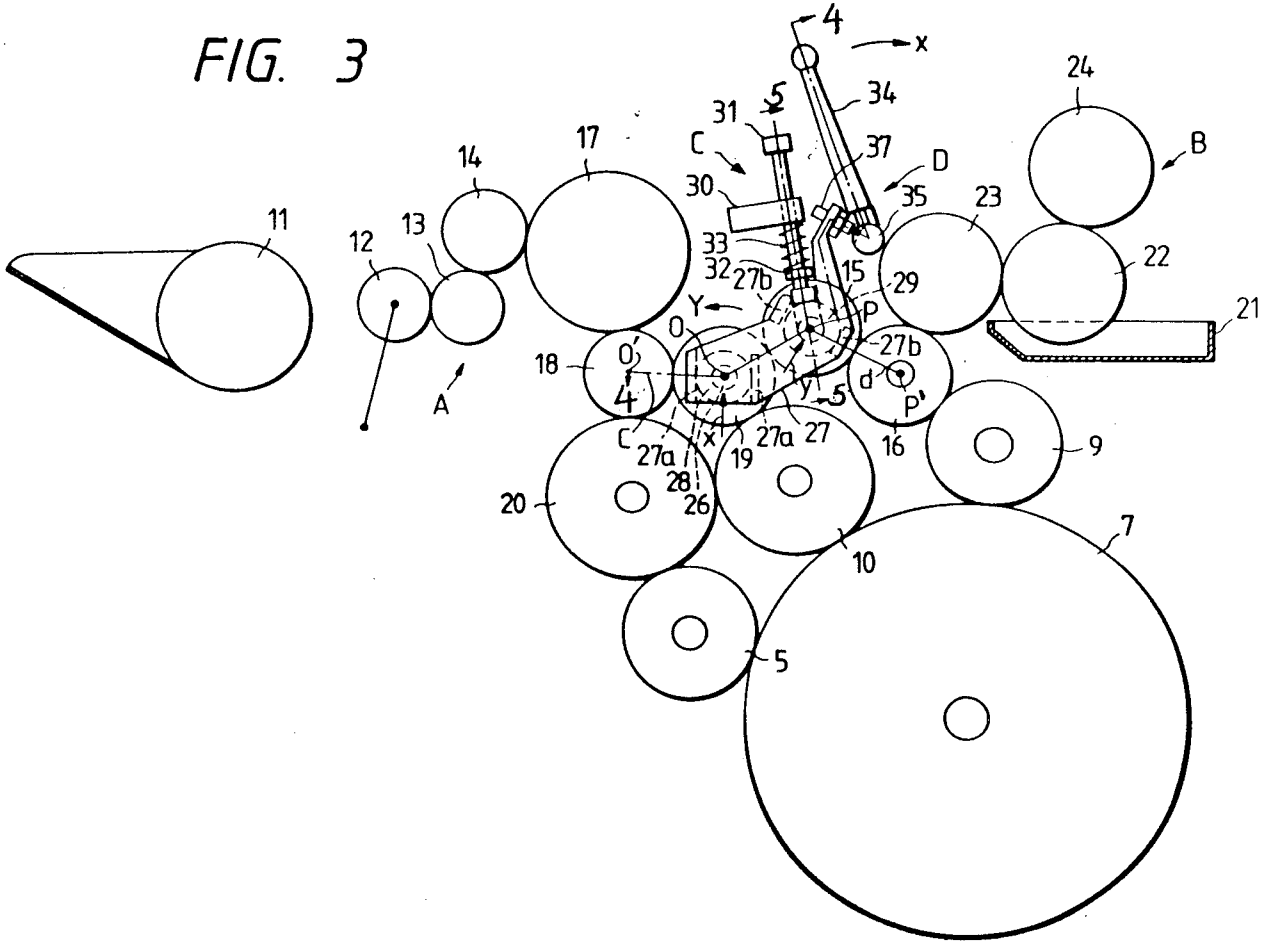
FIG. 3 is a vertical cross-sectional view showing a device for connecting and disconnecting dampening and inking systems in an offset printing machine according to the present invention
Figure 4:
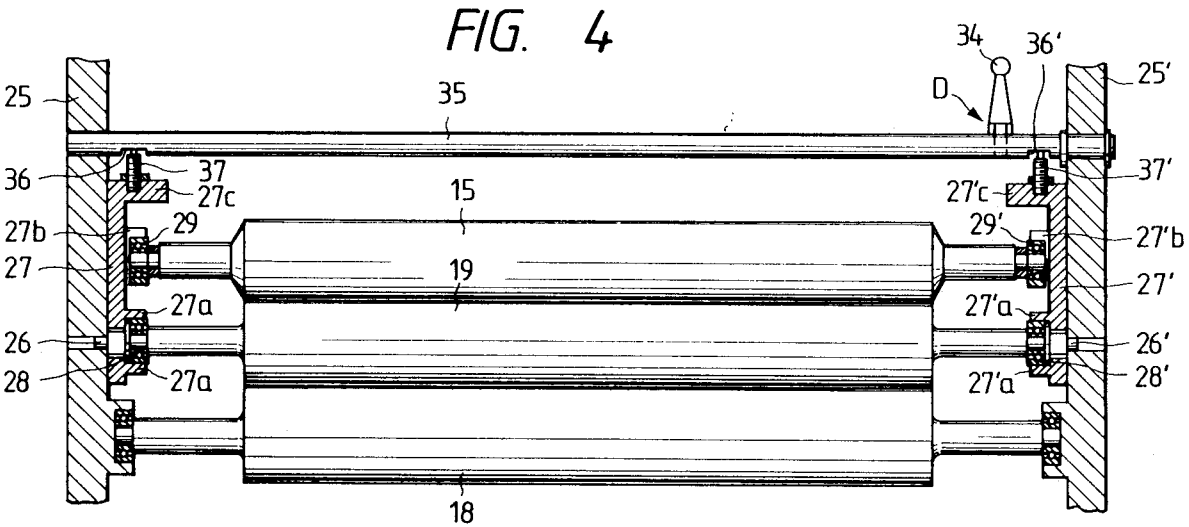
FIG. 4 is a cross-sectional view taken along a line IV-IV of FIG. 3; and, FIG. 5 is a cross-sectional view taken alone a line V-V of FIG. 3.
Figure 5:
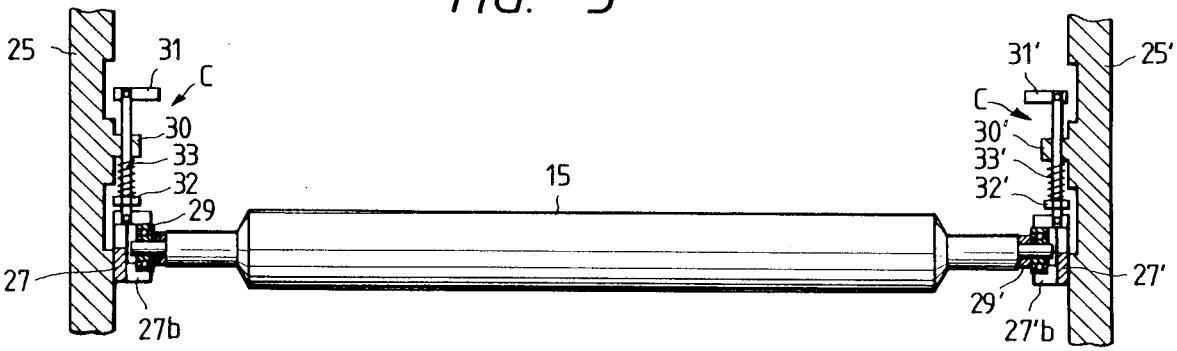

As shown in FIGS. 3 through 5, an inking system A includes e first roller train substantially the same as those shown in FIG. 1(*a*). More specifically, the ink supply system A includes an ink fountain roller 11, ink applicator rollers 5, 10, an ink ductor roller 12, an ink fast roller 13, a first ink delivery roller 14, an ink delivery transfer roller 17, a second ink delivery roller 18, a third ink delivery roller 19, and an ink transfer roller 20. These rollers of the inking system A are rotatable in synchronism with operation of an offset printing machine.

A dampening system B includes another roller train substantially the same as those shown in FIG. 1(*a*). More specifically, the dampening roller system includes a dipping roller 22 rotatably dipped in a fountain or a tank 21, an applicator roller 9, a metering roller 24, a dampening medium distributor or ductor roller 23 and a transfer roller 16. These rollers of the dampening system B are rotatable in synchronism with operation of the offset printing machine, or several rollers in the dampening systems are driven by an independent motor (not shown).

The amount of a dampening medium supplied from the dampening medium tank 21 can be regulated by adjusting the pressure at which the metering roller 24 is pressed against the dipping roller 22, or by a conventional dampening medium ductor roller 23' shown in FIG. 1(*b*). The inking and dampening systems A and B are shown as being the same as those of the known arrangement, but the present invention is not limited to the illustrated structure. Rather, the inking system A and the dampening system B may be of any desired configuration insofar as they comprise a group of rollers and have a mechanism for regulating the amount of ink and a dampening medium to be supplied.

A device for connecting and disconnecting the inking and dampening systems will next be described. In this device according to this invention, a special arrangement is provided with respect to the conventional distributor or intermediate roller 15 and the third ink delivery roller 19 shown in FIG. 1(*a*). The rollers 19 and 15 are referred to as "first and second rollers", respectively in the claims.

As illustrated in FIGS. 3 through 5, the first roller 19 (i.e., the third ink delivery roller 19) and the second roller 15 (hereinafter referred to as a distributor roller 15) are rotatably supported on and between a pair of brackets 27, 27' and are slidable with respect to the brackets. The brackets 27, 27' are angularly movable about pins 26, 26' mounted on respective inking frames 25, 25'. These pins 26 26' are in alignment with a rotation axis 0 (see FIG. 3) of the third ink delivery roller 19 when the ink applicator rollers 5, 10 are in a rested position, that is, they are held against the plate cylinder 7. (The position of the rotation axis is however changeable in accordance with the sliding movement of the roller 19 with respect to the brackets 27 27').

More specifically, the third ink delivery roller 19 is rotatably and slidably supported by the brackets 27, 27' through bearings 28, 28' and guide plates 27*a*, 27'*a*. The bearings 28, 28' are mounted on the opposite ends of a shaft of the third ink delivery roller 19 and are fitted between guides 27*a* and guides 27'*a*. These guides extend in parallel with each other in a first direction x and project from the brackets 27, 27' in a direction perpendicular thereto. Therefore, the bearings 28, 28' are movable in the x direction, so that the roller 19 is movable in the x direction. Here the direction x is oriented in a direction perpendicular to a line c extending between the rotation axis 0 of the third ink delivery roller 19 and a stationary rotation axis 0' of the immediate upstream side roller 18, i.e., the second ink delivery roller 18 which supplies ink to the third ink delivery roller 19.

Similarly, the distributor roller 15 is also rotatably and slidably supported by the brackets 27, 27' through bearings 29, 29' and guides 27*b*, 27'*b*. The bearings 29, 29' are mounted on the opposite ends of a shaft of the distributor roller 15 and are fitted between guides 27*b* and guides 27'*b*. These guides extend in parallel with each other in a second direction y and project from the brackets 27, 27' in a direction perpendicular thereto. Therefore, the bearings 29, 29' are movable in the y direction, so that the roller 15 is movable in the y direction. Here the direction y is oriented in a direction perpendicular to a line d extending between a rotation axis P of the distributor roller 15 (the position of the axis P is defined at a rested position of the roller 15) and a fixed rotation axis P' of the neighbouring roller, i.e., the transfer roller 16 to which ink from the distributor roller 15 is applied.

With this arrangement, the pressure under which the second and third ink delivery rollers 18, 19 are held against each other and the pressure under which the distributor roller 15 and the transfer roller 16 are held against each other remain unchanged, even then the ink applicator roller 10 is brought into and out of contact with the plate cylinder 7 or the distributor roller 15 and the transfer roller 16 are brought into and out of contact with each other.

In accordance with the present invention, there is further provided a biasing means C mounted on each of the frames 25, 25' for normally urging the distributor roller 15 toward the neighbouring rollers such as the third ink delivery roller 19 and the transfer roller 16. Because of this biasing manner, the third ink delivery roller 19 remains in contact with its neighbouring rollers such as the ink applicator roller 10 and the second ink delivery roller 18 without any spaced relationship, and further, the transfer roller 16 remains in contact with its neighbouring roller such as the dampening medium applicator roller 9 without any spaced relationship.

Details of the biasing means C will be described. Pusher pins 31,31' are slidably inserted through respective projection plates 30,30' integrally extending from the side frames 25 25'. These pins 30,30' have tip ends held against the outer peripheries of the bearings 29,29' fixed to the opposite ends of the distributor roller 15. Compression springs 33,33' are disposed around the respective pusher pins 31,31' between the projection plates 30,30' and nuts 32,32' threadingly engaged with the pusher pins 31,31' at positions near their tip ends for normally urging the pusher pins 31,31' toward the distributor roller 15.

The nuts 32,32' serve to adjust the biasing forces of the compression springs 33,33'. The pressure under which the distributor roller 15 is held against the third ink delivery roller 19 can be adjusted by turning the nuts 32,32' with respect to the pusher pins 31,31'.

The biasing means C may comprise resilient elements other than the compression springs 33,33'. For example, tension springs and leaf springs are available.

In accordance with the present invention there is further provided a roller pressing/releasing means (means for pivoting the brackets 27, 27') D for pressing and releasing the distributor roller 15 against and from the transfer roller 16. This roller pressing/releasing means D is provided at the inking frames 25, 25', and has the following structure.

A shaft 35 to which a lever handle 34 is connected is rotatably supported between the frames 25,25' at a position near the dampening system B. The shaft 35 has opposite end portions each formed with cams 36,36' which are engageable with free ends 27*c*, 27'*c* of the brackets 27,27', respectively. By turning the lever handle 34 in the direction indicated by an arrow X in FIG. 3 for rotating the shaft 35 about its axis, the brackets 27,27' are pivotally moved in the direction indicated by an arrow Y about the pins 26,26' by cam lobes of the cams 36,36'. The distributor roller 15 is now separated from the transfer roller 16. The distributor roller 15 can be brought into contact with the transfer roller 16 by turning the lever handle 34 in the direction opposite the direction X.

More specifically, when the free ends 27*c*, 27'*c* of the brackets 27, 27' are held against lower surfaces of the cams 36,36', the distributor roller 15 remains in contact with the transfer roller 16. When the free ends 27*c*,27'*c* are brought into engagement with the higher cam level surface of the cams 36, 36', the rollers 15,16 are disengaged from each other. In this manner, the inking system A and the dampening system B can be brought into and out of contact with each other, i.e., connected to and disconnected from each other.

Screws 37,37' may threadingly extend through the free ends 27*c*,27'*c* of the brackets 27,27', so that the tip ends of the screws are engageable with the cams 36,36'. By rotating the screws 37,37' about their axes for axially moving the tip ends of the screws relative to the free ends of the brackets, the pivot angle of the brackets 27 and 27' about the pins 26,26' is controllable, and therefore, contact pressure between the distributor roller 15 and the transfer roller 16 is controllable.

With the structure thus organized, when the brackets 27, 27' supporting the second roller 15 are angularly moved in the direction Y by means of the roller pressing/releasing means D while ink and dampening medium applicator rollers 5, 10, 9 are being held against the plate cylinder 7, the brackets 27 27' are turned about the pivot pins 26 26' coaxial with the axis of rotation of the first roller 19, to thereby move the second roller 15 out of contact with the neighbouring roller, i.e.. the dampening medium transfer roller 16, while the first roller 19 remains in contact with the ink applicator roller and the neighbouring roller, i.e., the second ink delivery roller 18. Therefore, the inking and dampening systems A and B are separated from each other.

By pivoting the brackets 27 27' in the direction opposite the direction Y by means of the roller pressing/releasing means D, the second roller 15 returns to a position in contact with the dampening medium transfer roller 16, whereupon the inking and dampening systems are connected to each other.

When the ink applicator rollers 5, 10 are separated from the plate cylinder 7, the first and second rollers 19 and 15 are allowed to slide with respect to the guides 27*a*, 27'*a*, 27*b*, 27'b in the direction x, y, respectively, against the biasing force of the biasing means C. In this case, the inking and dampening systems A and B can be connected to and disconnected from each other without varying the pressure under which the second ink delivery roller 18 and the first roller 19 are held against each other and also the pressure under which the second roller 15 and the dampening medium transfer roller 16 are held against each other. As a result, such inking and dampening system are connected and disconnected from each other irrespective of whether or not the dampening medium applicator roller 19 or the ink applicator roller 10 is in contact with the plate cylinder 7.

In the illustrated embodiment, the shaft 35 is supported on the frames 25,25' near the dampening system B and the cams 36,36' push the brackets 27, 27' to angularly move the brackets 27,27'. However, in a modification, the shaft 35 may be positioned remotely from the dampening system B and the brackets 27,27' may be engaged by pulleys with the cams 36,36' for angular movements of the brackets. The cams 36,36' may alternatively be replaced with link mechanisms or any other known swinging means.

In a further modification, the brackets 27,27' may be supported of the frames 25,25', respectively, so as to be swingable about the rotation axis P of the transfer roller 16, so that the distributor roller 15 can be brought into and out of contact with the third ink delivery roller 19. In any case, the fluid connection and disconnection between the inking system A and the dampening system B is attainable.

With the arrangement of the present invention, no matter how the dampening medium applicator roller g and the ink applicator rollers 5,10 may be positioned with respect to the plate cylinder 7, the inking system A and the dampening system B can easily be connected to and disconnected from each other by angularly moving the brackets 27,27' without varying the contact pressure between the inking and dampening roller systems.

For example, in the illustrated embodiment, the brackets 27,27' support the first and second rollers 19,15, i.e., the third ink delivery roller 19 and the distributor roller 15, without varying the contact pressure between these rollers 19 and 15, and the roller 15 is movable toward and away from the transfer roller 16. In this case, these rollers 19 end 15 are considered to belong to the inking roller system A and the roller 16 belongs to the dampening roller system. In the further modification wherein the brackets are swingable about the axis P' and the distributor roller 15 is brought into and out of contact with the third ink delivery roller 19, the rollers 15 and 16 are considered to belong to the dampening roller system B and the roller 19 belongs to the inking roller system A.

Thus, the inking and dampening systems A and B can be connected to and disconnected from each other irrespective of whether the ink applicator rollers 5,10 are held against the plate cylinder 7 or not. In particular, the inking and dampening systems A and B can be separated from each other through a simple arrangement while the ink applicator rollers 5, 10 are held in contact with the plate cylinder 7.

Although a certain preferred embodiment has been shown and described, it should be understood that many changes and modifications may be made therein without departing from spirit and scope of the invention.

What is claimed is:

1. A device for connecting and disconnecting a dampening system (B) and an inking system (A) in an offset printing machine, the offset printing machine including a plate cylinder (7), and the dampening system including a first roller train having a plurality of rollers and a dampening medium applicator roller (9) contactable with the plate cylinder, and the inking system including a second roller train having a plurality of rollers and at least one ink applicator roller (10) contactable with the plate cylinder, the device comprising:

a frame body having side walls (25, 25');

a pair of brackets (27,27') individually pivotally supported to said side walls and pivotally movable about a pivot axis (26,26');

a first intermediate roller (19) rotatably supported to the pair of brackets, the first intermediate roller being also slidable with respect to the brackets in a first direction (x), the first intermediate roller being biased towards a rest position whereat the ink applicator roller is in contact with the plate cylinder, and having a rotation axis (O) at the rest position, the first intermediate roller also being in rotational contact with a first stationary neighbouring roller (18) positioned immediately upstream thereof, said neighbouring roller belonging to the inking system and having a stationary rotation axis (O'), the first direction being oriented perpendicular to a line (c) extending between the rest position rotation axis and the stationary rotation axis;

a second intermediate roller (15) rotatably supported to the pair of brackets, the second intermediate roller also being slidable with respect to the brackets in a second direction (y), the second intermediate roller being biased towards a rest position whereat the ink applicator roller is in contact with the plate cylinder, and having a rotation axis (P) at the rest position, the second intermediate roller also being in rotational contact with a second stationary neighbouring roller (16) positioned immediately upstream thereof, said second neighbouring roller belonging to the dampening system and having a stationary rotation axis (P'), the second direction being oriented perpendicular to a line (d) extending between the rest position rotation axis (P) of the second intermediate roller and the stationary rotation axis (P') of the second neighbouring roller; and, means (D) for pivoting the brackets about the rest rotation axis (O) of the first intermediate roller, the means for pivoting being connected to the brackets for moving the second intermediate roller toward and away from the neighbouring second stationary roller, such that the dampening system and the inking system may be selectively connected to each other or disconnected from each other.

2. The device as defined in claim 1, wherein the first intermediate roller is biased through the second intermediate roller towards the rest position of the first intermediate roller.

3. The device as defined in claim 2, wherein the rest position axis of the first intermediate roller (19) is coaxial with the pivot axis of the brackets, so that the second intermediate roller (15) is movable toward and away from the second stationary neighbouring roller (16) which belongs to the dampening system (B).

4. The device as defined in claim 3, wherein the first and the second intermediate rollers are slidable with respect tot he brackets (27,27') in response to a movement of the ink applicator roller in a direction away from the plate cylinder.

5. The device as defined in claim 4, wherein the inking system (A) comprises the second roller train having, in order, an ink fountain roller (11), an ink ductor roller (12), an ink fast roller (13), a first ink delivery roller (14), an ink delivery transfer roller(17), said first stationary neighbouring roller(18), said first intermediate roller (19), and the ink applicator roller (10), the first intermediate roller being positioned between and in rotational contact with the first stationary neighbouring roller and the ink applicator roller.

6. The device as defined in claim 5, wherein the dampening system (B) comprises the first roller train having, in order, a fountain roller (22), a metering roller (24), a distributor roller (23), said second stationary neighbouring roller (16), and the dampening medium applicator roller (9).

7. The device as defined in claim 6, further comprising means (C) mounted on the frame body for biasing the second intermediate roller (15 towards the rest position thereof.

8. The device as defined in claim 7, wherein the first intermediate roller has a rotation shaft having opposite ends thereof provided with a set of bearings, and wherein the brackets have first guide members (27*a*, 27′*a*) extending in the first direction, the bearings being slidable with respect to the first guide members.

9. The device as defined in claim 8, wherein the second intermediate roller has a rotation shaft having opposite ends thereof provided with another set of bearings, and wherein the brackets have second guide members 27*b*, 27′*b*) extending in the second direction, said another set of bearings being slidable with respect to the second guide members, and the biasing means being connected to said another set of bearings.

10. The device as defined in claim 9, wherein each of the side walls of the frame body is provided with a projection plate (30,30′), and wherein the biasing means comprises:

pusher pins (31,31′) individually movably supported to the projection plates and formed with a thread, the pusher pins having tip ends in individual abutment with said another set of bearings;

nuts (32,32′) individually threadingly engaged with the threads; and compression springs (33,33′) individually disposed over the pusher pins and interposed between the projection plates and the nuts.

11. The device as defined in claim 7 wherein the brackets have free ends (27*c*,27′*c*), and wherein the means for pivoting comprises:

a shaft (35) extending between the side walls, the shaft being formed with cam surfaces (36, 36′); and a lever (34) fixedly connected to the shaft for rotating the shaft about an axis thereof, the free ends of the brackets being in biased abutment with the cam surfaces.

* * * * *